US008967206B2

(12) United States Patent
Donovan

(10) Patent No.: US 8,967,206 B2
(45) Date of Patent: Mar. 3, 2015

(54) FLEXIBLE FLUID CONDUIT

(75) Inventor: Matthew R. Donovan, Ankeny, IA (US)

(73) Assignee: Delavan Inc., Wesr Des Moines, IA (US)

( * ) Notice: Subject to any disclaimer, the term of this patent is extended or adjusted under 35 U.S.C. 154(b) by 1106 days.

(21) Appl. No.: 12/928,908

(22) Filed: Dec. 22, 2010

(65) Prior Publication Data

US 2012/0160360 A1 Jun. 28, 2012

(51) Int. Cl.
*F16L 11/00* (2006.01)
*B21C 37/15* (2006.01)

(52) U.S. Cl.
CPC ..... *B21C 37/154* (2013.01)
USPC ..... 138/137; 138/177; 138/114; 138/142

(58) Field of Classification Search
USPC ..... 138/177, 178, 142, 114, 137
See application file for complete search history.

(56) References Cited

U.S. PATENT DOCUMENTS 3,897,009 A * 7/1975 Rangel-Garza et al. ..... 239/542
4,022,384 A * 5/1977 Hoyle et al. ..... 239/542
4,432,411 A * 2/1984 Hooper ..... 165/47
4,859,264 A * 8/1989 Buluschek ..... 156/244.13
6,321,541 B1 11/2001 Wrubel
6,718,770 B2 4/2004 Laing
7,963,299 B2 * 6/2011 Sheldrake ..... 138/110
8,312,931 B2 * 11/2012 Xu et al. ..... 166/373
8,646,535 B2 * 2/2014 Xu et al. ..... 166/373

FOREIGN PATENT DOCUMENTS

JP 10118315 A 5/1989
JP 11254033 A 9/1999

OTHER PUBLICATIONS

Combined Search and Examination Report issued Feb. 20, 2012 for UK Patent Application No. 1121867.4.

* cited by examiner

*Primary Examiner* — Patrick F Brinson
(74) *Attorney, Agent, or Firm* — Locke Lord LLP; Scott D. Wofsy; Christopher J. Capelli

(57) ABSTRACT

A process for producing a fluid conduit by forming a fluid delivery channel along the outer surface of a first elongate tubular body member. A second elongate tubular body having an inner circumference is fitted about the outer circumference of the first tubular body so as to seal the at least one fluid delivery channel on the outer surface of the first tubular body. A section of the fitted first and second tubular assembly is removed therefrom so as to define a fluid delivery channel in the form of a sealed fluid conduit.

13 Claims, 6 Drawing Sheets

FLEXIBLE FLUID CONDUIT

FIELD OF THE INVENTION

The invention relates to generally to fluid delivery systems, and more specifically, to a flexible fuel delivery conduit for use in gas turbine applications.

BACKGROUND OF THE INVENTION

In a gas turbine engine, fuel burns within the combustor to generate heat so as to provide energy to the turbine section of the engine. The generated heat being very intense, some of it tends to spread to parts surrounding the combustor, such as the fuel nozzles and its fuel supply conduit. Typically one or more fuel nozzles are provided around the combustor to supply fuel. Oftentimes, fuel flowing from fuel supply tubes in the fuel delivery conduit to the fuel nozzles will heat and each separate component of the conduit may expand at different rates due to the various coefficients of thermal expansion for each conduit component. This expansion of the fuel delivery conduit often causes stress on the fuel supply components of the conduit assembly.

It would be beneficial therefore to provide a fuel delivery component which conforms to a fuel conduit which fuel delivery component is configured to expand along an axis of thermal expansion growth of the fuel conduit component while maintaining its structural integrity.

SUMMARY OF THE INVENTION

In one aspect, a process for producing a fluid conduit is described in which an aspect of the invention includes forming at least one fluid delivery channel along the outer surface of a first elongate tubular body member. The first elongate tubular body member defining a longitudinal axis and an outer curved surface having a radius of curvature. A second elongate tubular body having an inner circumference is fitted about the outer circumference of the first tubular body so as to seal the at least one fluid delivery path channel on the outer surface of the first tubular body. A section of the fitted first and second tubular assembly is removed therefrom so as to define at least one fluid delivery path in the form of a sealed fluid conduit.

In further aspects, the foregoing product by process can include the steps of defining a plurality of fluid delivery channels along the outer surface of a first elongate tubular body member wherein each fluid delivery channel has at least one curved section defined by a first portion parallel to the longitudinal axis of the first tubular body, a second portion not parallel to the longitudinal axis of the first tubular body, and a third curved portion defined between the first and second portions and wherein each of the fluid delivery channels is formed so as to be nested relative to one another on the first tubular body. A second elongate tubular body having an inner circumference is sealed about the outer circumference of the first tubular body so as to seal each fluid delivery path channel defined along the outer surface of the first tubular body. A plurality of sections from the fitted first and second tubular bodies are removed wherein each removed section corresponds to a respective fluid delivery channel so as to define a plurality of expandable fluid conduits which may be affixed for use in nested relationship to one another.

BRIEF DESCRIPTION OF THE DRAWINGS

The objects and features of the invention can be understood with reference to the following detailed description of an illustrative embodiment of the present invention taken together in conjunction with the accompanying drawings in which.

WRITTEN DESCRIPTION OF CERTAIN EMBODIMENTS OF THE INVENTION

Figure 1:
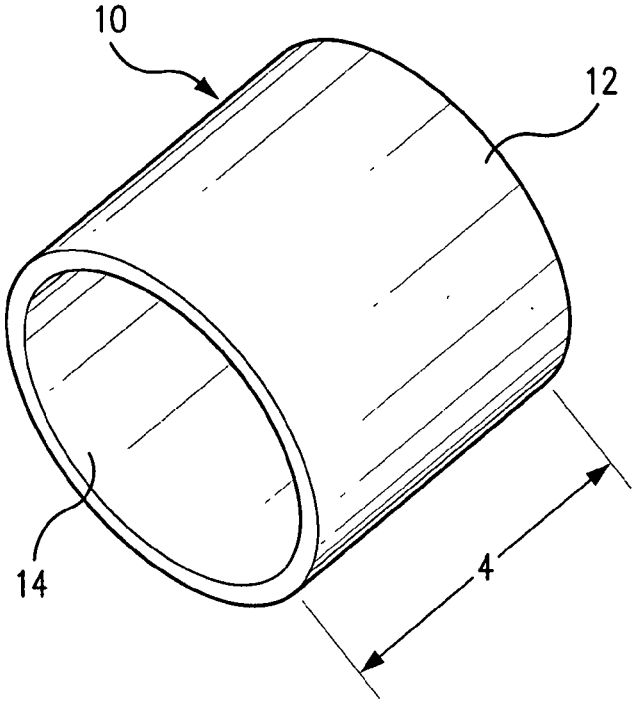
FIG. 1 is a perspective view of a first inner tubular body member used in accordance with an illustrated embodiment of the invention.

The present invention is now described more fully with reference to the accompanying drawings, in which illustrated embodiments of the present invention are shown. The present invention is not limited in any way to the illustrated embodiments as the illustrated embodiments described below are merely exemplary of the invention, which can be embodied in various forms, as appreciated by one skilled in the art. Therefore, it is to be understood that any details disclosed herein are not to be interpreted as limiting, but merely as a basis for the claims and as a representative for teaching one skilled in the art to variously employ the present invention. Furthermore, the terms and phrases used herein are not intended to be limiting but rather to provide an understandable description of the invention.

It is to be appreciated what is to be described below is a fluid conduit configured to be expandable along multiple axis'. The fluid conduit may be used in a host of applications suitable for use with such an expandable fluid conduit. In accordance with an illustrated embodiment, the present invention, for descriptive purposes, is described in conjunction with a fuel delivery conduit preferably configured for use in gas turbine applications such as a liquid delivery manifold or supply tube designed for a high temperature environment where components of the gas turbine heat and expand at different rates. A noted advantage of providing an expandable liquid delivery manifold or supply tube is it permits fuel to be delivered between components operating under a high temperature by allowing for thermal expansion of the liquid delivery manifold or supply tube which mitigates the stress placed upon such a liquid delivery manifold or supply tube created by high temperatures.

As will be depicted in accordance with illustrated embodiments, the present invention provides a fuel tube that curves in multiple dimensions enabling it to confirm around a particular configured fuel component while permitting the fuel tube to expand along an axis of growth for a particular configured fuel component while maintaining its structural integrity. Therefore, what is to be appreciated and understood from the below description is a fuel delivery component (e.g. fuel tube, liquid delivery manifold, supply tube and the like) having a resultant geometry providing an enhanced reliable end position and stress profile relative to conventional mechanically bent fuel tubes. It is to be appreciated the below described fluid conduit, in accordance with the illustrative embodiments, is not to be understood to be restricted to a conduit for use with delivery of fluids, but may likewise be also used in conjunction with delivery of gaseous matter.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

Starting with reference to FIG. 1, in accordance with the below illustrated embodiments, the process by which a present invention fluid conduit is produced will now be described. As shown, a first inner tubular body member, designated generally by reference numeral 10, is provided, which as to be described below, is used to form a fluid conduit. First inner tubular body member 10 preferably has a cylindrical configuration having a circular cross-section as shown, but is not to be understood to be limited thereto as it may have any cylindrical configurations (e.g., elliptical) or other configurations (e.g., a squared shape cross-sectional body tubular body member) required for a particular application. First inner tubular body member 10 defines a longitudinal axis (as designated by arrow "A") and is defined by outer 12 and inner 14 cylindrical surfaces. First inner tubular body member 10 may be fabricated from any material suitable for a particular fluid conduit application. For instance, when a produced fluid conduit is used as a fuel delivery conduit configured for use in gas turbine applications such as a liquid delivery manifold or supply tube designed for a high temperature environment where components of the gas turbine heat and expand at different rates, the first inner tubular body member 10 is preferably fabricated from a nickel-based temperature alloy such as Inconel® or a highly corrosion or oxidation resistant stainless steel.

Figure 2:
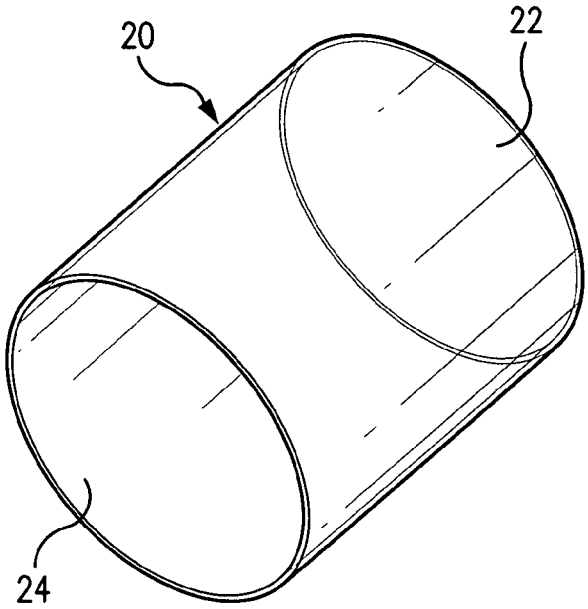
FIG. 2 is a perspective view of a second outer tubular body member used in accordance with an illustrated embodiment of the invention.

With reference now to FIG. 2, a second outer tubular body member, designated generally by reference numeral 20 is provided, which as described below is used to provide a top seal for each fluid conduit formed in the first inner tubular member 10. Second outer tubular body member 20 preferably has a cylindrical configuration which confirms to that of the first tubular body member 10 also defined by an outer 22 and inner 24 cylindrical surface wherein in an exemplary illustrated embodiment of the invention the diameter of its inner cylindrical surface 24 is preferably slightly greater than the diameter of the outer cylindrical surface 12 of the first tubular member 10 such that the second outer tubular member 20 is fitted about the first inner tubular member 10, as described below. It is to be understood, in another embodiment of the invention, the diameter of inner cylindrical surface 24 of the second tubular member 20 is preferably slightly less than the diameter of the outer cylindrical surface 12 of the first tubular member 10 such that the second outer tubular member 20 is fitted about the first inner tubular member 10 by a heat/freeze shrink process so as to fit the second outer tubular member 20 about the first inner tubular member 10 via an interference fit.

Like the first inner tubular body member 10, it is to be understood and appreciated the second outer tubular member 20 may be fabricated from any material suitable for a particular fluid conduit application. For instance, a fluid conduit may be used as a fuel delivery conduit configured for use in gas turbine applications such as a liquid delivery manifold or supply tube designed for a high temperature environment where components of the gas turbine heat and expand at different rates.

Figure 3A:
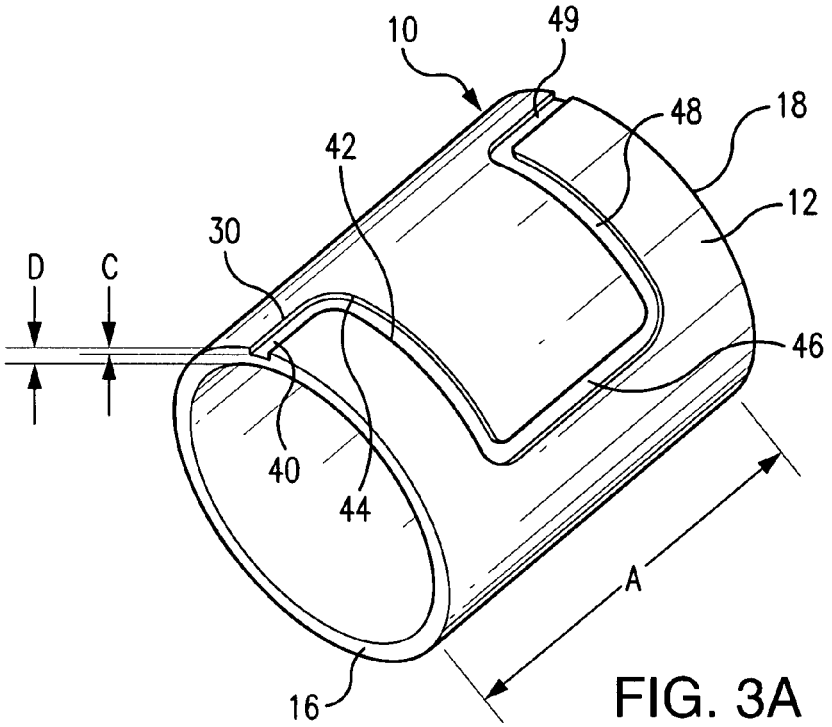
FIG. 3A is a perspective view of the first inner tubular body member of FIG. 1 having a channel formed along its outer surface.
Figure 3B:
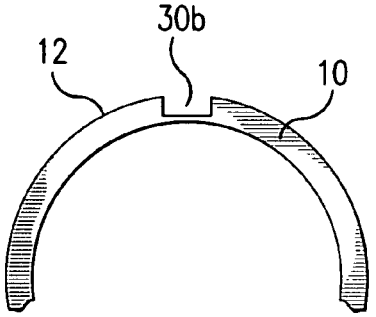
FIGS. 3B-3D are cross-sectional views of the first inner tubular body member of FIG. 3A depicting illustrative cross-sectional profiles of the fluid channel formed in the first inner tubular body member of FIG. 3A.
Figure 3C:
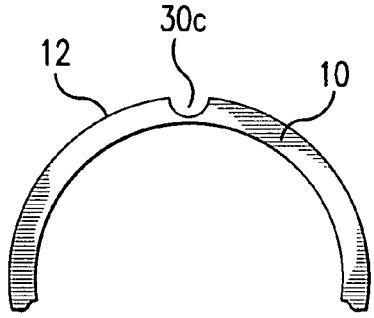
Figure 3D:
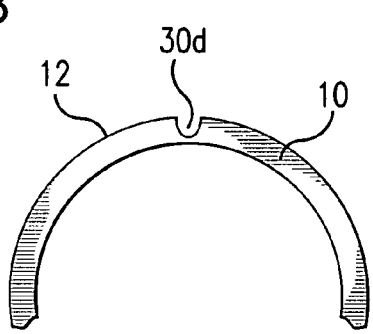

With reference now to FIG. 3A, shown is the first outer tubular body member 10 wherein a channel 30 is formed along the outer surface 12 of the first tubular body member 10 preferably extending from a first end 16 to a second end 18 of the first inner tubular body member 10. It is to be understood and appreciated the channel 30 may be formed along the outer surface 12 of the first inner tubular body member 10 using any suitable process for doing so (e.g., via a router means, laser, chemical etching and the like). It is to be further understood and appreciated the channel 30 may be formed to have any desired cross-sectional configuration, such as a squared configuration 30B (FIG. 3B), a circular configuration 30C (FIG. 3C) or an elliptical configuration 30D (FIG. 3D). As shown, the channel is formed to have a desired depth (as indicated by arrow "C") on the outer surface 12 of the first inner tubular member 10, which is preferably less than the thickness (as indicated by arrow "D") defining the cylindrical wall of the first inner tubular member 10.

It is to be appreciated channel 30 is formed on the outer surface 12 of first inner tubular member 10 between its first 16 and second 18 ends to any desired pattern, including helical (in which the channel would be formed to wrap around the outer surface 12 of first inner tubular member 10). As shown in the illustrated embodiment of FIG. 3A, a portion of the channel 30 is formed to have a first portion 40 parallel to the longitudinal axis "A" of the first inner tubular body member 10, a second portion 42 not parallel to the aforesaid longitudinal axis "A" and a third curved portion 44 defined between the first 40 and second 42 portions. Thus, as shown in the illustrated embodiment of FIG. 3A, the channel 30 is formed to have portions 40, 46 and 49 which extend substantially along the longitudinal axis "A" and portions 42, 48 which extend substantially perpendicular to the longitudinal axis "A", of the first inner tubular body member 10, the significance of which will be apparent below.

Figure 4:
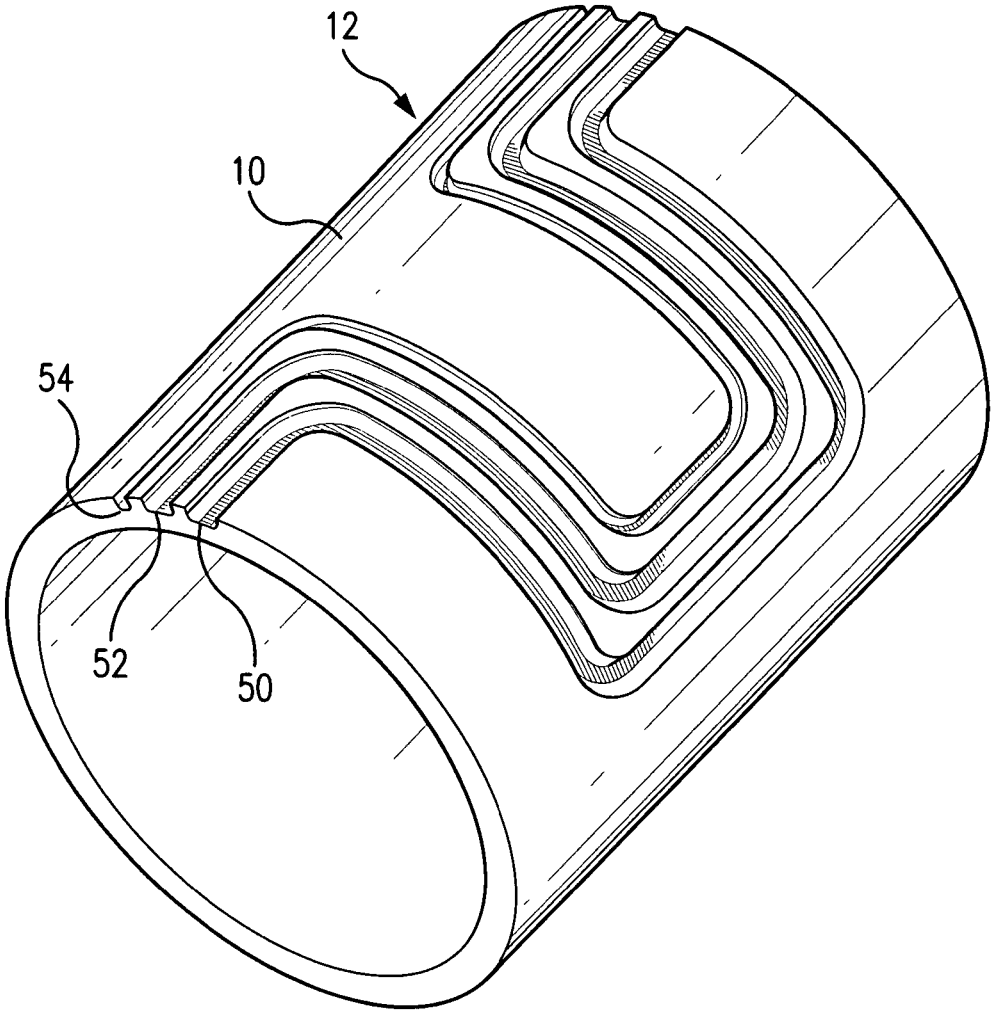
FIG. 4 is a perspective view of a first inner tubular body member of FIG. 1 having multiple nested channels formed along its outer surface.

Additionally, it is to be appreciated and understood that while the illustrated embodiment of FIG. 3A depicts a single channel 30 formed in the first inner tubular body member 10, a plurality of such channels, with same or varying cross-sectional configurations and/or patterns, may be formed along the outer surface 12 of the first inner tubular body member 10. For instance, with reference to another illustrated embodiment of the invention as shown in FIG. 4, the first inner tubular body member 10 is shown to have first, second and third 50, 52 and 54 channels formed along its outer surface 12, wherein each first, second and third 50, 52 and 54 channel is preferably formed in a nested relationship to one another.

Figure 5:
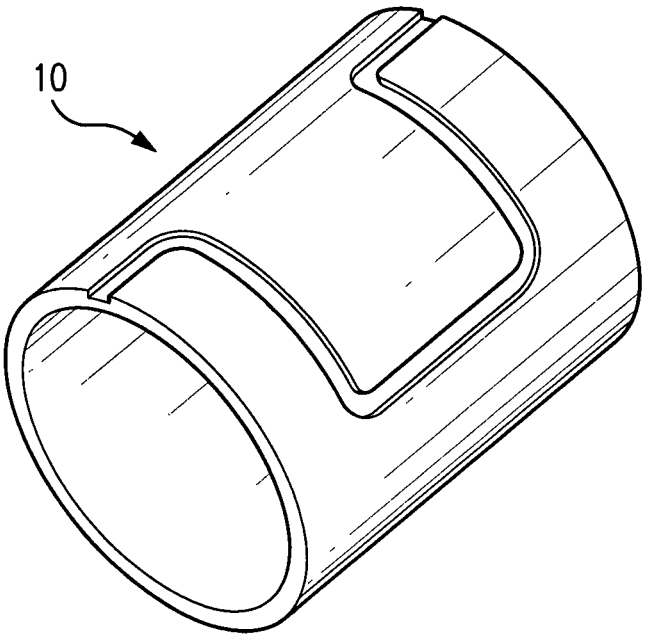
FIG. 5 is a perspective view of a first inner tubular body member of FIG. 3 plated with a brazing alloy.
Figure 6:
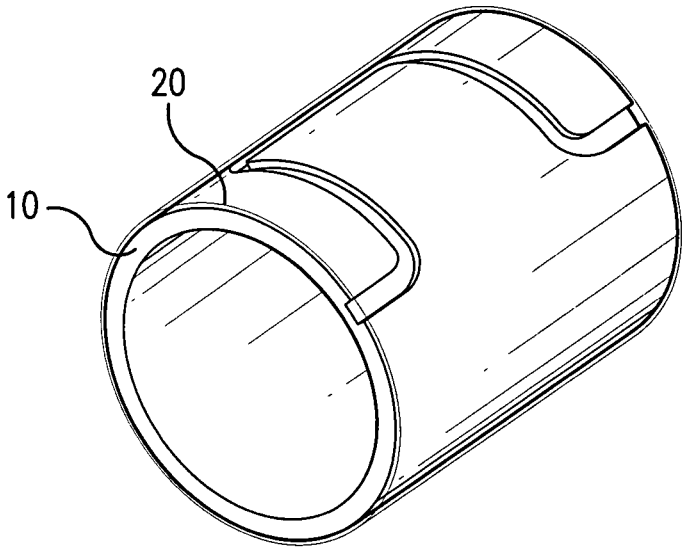
FIG. 6 is a perspective view of a first inner tubular body member of FIG. 5 brazed and fitted to the second outer tubular member of FIG. 2.

Once the desired channels are formed on the outer surface 12 of the first inner tubular body member 10, the outer surface portion 12 of the first inner tubular body member 10 is preferably plated with a suitable brazing alloy (e.g., such as nickel phosphorus or nickel boron) as illustrated in FIG. 5. Next, and with reference to FIG. 6, the second outer tubular member 20 is fitted about, and preferably brazed to, the outer surface 12 of the first inner tubular member 10 so as to provide a top seal (e.g., the inner surface 24 of the second outer tubular member 20) to each aforesaid channel 30 formed on the outer surface 12 of the first inner tubular body member 10. Thus, each aforesaid channel 30 formed on the outer surface 12 of the first inner tubular body member 10 now forms a liquid passage or fluid conduit with the first and second fitted tubular members 10, 20 now forming a unitary structure. It is to be appreciated and understood that the aforesaid affixation of the second outer tubular member 20 to the first inner tubular body member 10 is not to be limited to a brazing process but rather may include any suitable means for affixation of the first and second tubular body members 10 and 20 to one another, including for example a welding, gluing or like a adhesive process which preferably provides a water-tight, gas-tight, and/or leak-tight seal between the affixed first and second tubular body members 10, 20.

Figure 7:
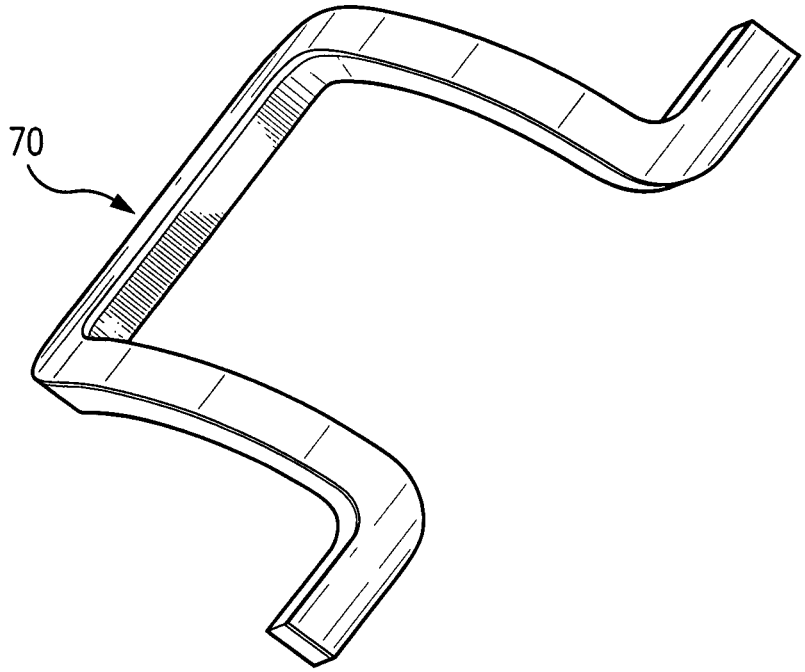
FIG. 7 is a perspective view of a fluid conduit removed from the assembly of the brazed and fitted first and second tubular body members of FIG. 6.
Figure 8:
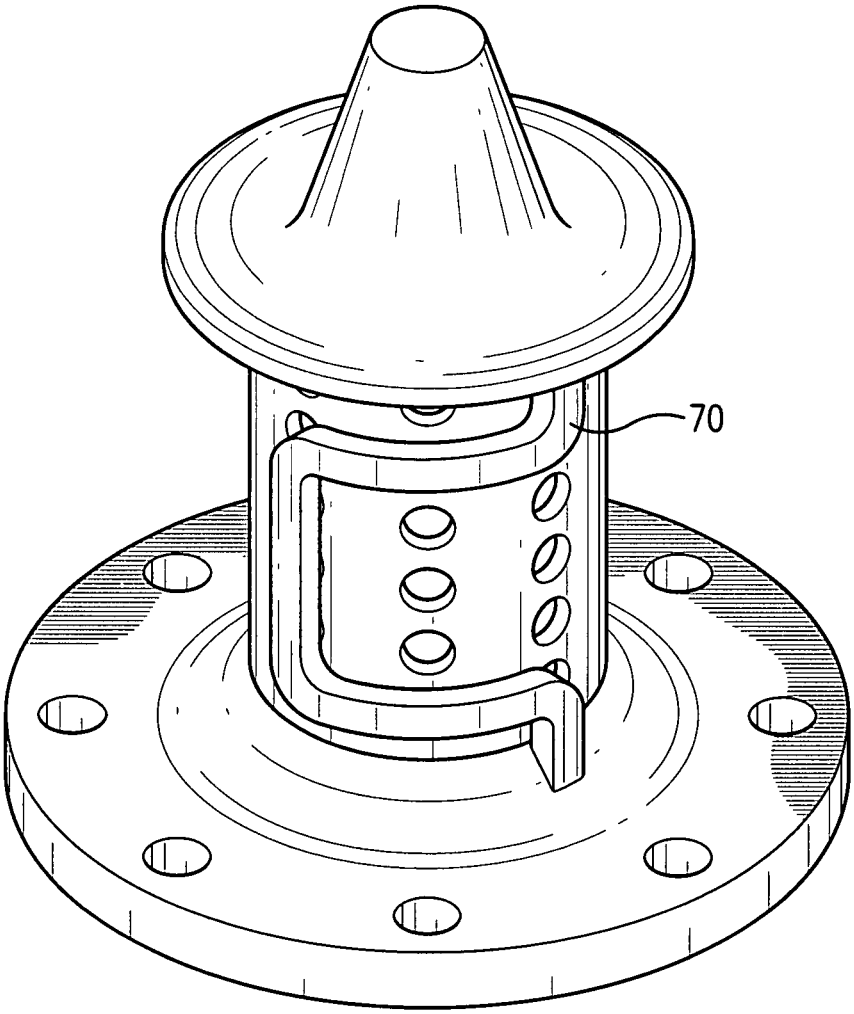
FIG. 8 is a perspective view of an environment of use for the fluid conduit of FIG. 7.

With reference now to FIG. 7, after the first and second tubular body members 10, 20 are affixed to one another, this assembly of the first and second tubular body members 10, 20 is preferably machined to remove a fluid conduit 70 formed by the channel 30 defined in the first inner tubular member 10 with the second outer tubular member 20 sealed thereto. Preferably, the fluid conduit 70 is machined from the assembly of the first and second tubular body members 10, 20 so as to only include enough supporting material from each aforesaid tubular body member 10, 20 to provide the necessary strength required for the intended function of the fluid conduit 70. It is to be appreciated that machining the fluid conduit 70 from the assembly of the first and second tubular body members 10 and 20 is not to be understood as the only process for doing so, as any suitable process (e.g., laser cutting) may be utilized. Additionally, if the assembly of the first and second tubular body members 10, 20 is to produce multiple fluid conduits arising from an embodiment where the first outer tubular member 10 is formed with multiple channels (FIG. 4), the aforesaid process is repeated with respect to each respective channel so as to produce a respective fluid conduit. For instance, in the illustrated embodiment of FIG. 4 in which three channels 50, 52 and 54 are formed in the outer surface 12 of the first inner tubular member 10, three distinct fluid conduits would result, wherein each fluid conduit may be affixed for use in nested relationship to one another. An illustrative environment of use for a fluid conduit 70 is shown in FIG. 8 depicting a fuel injector assembly as used in a power generation gas turbine engine.

It is to be appreciated and understood each portion (e.g., 40, 42, 44, 46, 48 and 49) of the resultant fluid conduit 70 is flexible, thus the fluid conduit 70 is expandable along multiple axis'. Hence, one use of fluid conduit 70 is as a fuel delivery component having a resultant geometry providing a more reliable end position and stress profile than a conventional fuel tube requiring multiple bends.

Although illustrated embodiments of the present invention has been described, it should be understood that various changes, substitutions, and alterations can be made by one of ordinary skill in the art without departing from the scope of the present invention. For instance, the invention is not to be understood to be limited for use with a single layer of fluid or gas channels but rather may be used with numerous layers of embedded fluid or gas channels with each being joined in a similar process as described above.

What is claimed is:

1. A fluid conduit prepared by a process comprising the steps of:

forming at least one fluid delivery channel along the outer surface of a first elongate tubular body, the first elongate tubular body defining a longitudinal axis and an outer curved surface having a radius of curvature;

fitting a second elongate tubular body about the outer circumference of the first tubular body so as to seal the at least one fluid delivery path channel on the outer surface of the first tubular body; and removing a section of the fitted first and second tubular bodies defining the at least one fluid delivery path so as to define the fluid conduit wherein the fluid conduit is expandable.

2. A fluid conduit as recited in claim 1, wherein a portion of the fluid conduit has radius of curvature substantially the same as the radius of curvature defined by the first elongate tubular body.

3. A fluid conduit as recited in claim 2, wherein the at least one fluid conduit has at least one curved section defined by a first portion parallel to the longitudinal axis of the first tubular body, a second portion not parallel to the longitudinal axis of the first tubular body, and a third curved portion defined between the first and second portions.

4. A fluid conduit as recited in claim 3, wherein the first tubular body has a cylindrical configuration.

5. A fluid conduit as recited in claim 3, wherein a plurality of fluid delivery channels are defined on the first tubular body.

6. A fluid conduit as recited in claim 5, wherein each of the fluid delivery channels is formed so as to be nested relative to one another.

7. A fluid conduit prepared by a process comprising the steps of:

forming at least one fluid delivery channel along the outer surface of a first elongate tubular body, the first elongate tubular body defining a longitudinal axis and an outer curved surface having a radius of curvature wherein the at least one fluid delivery channel is formed to have a helical configuration;

fitting a second elongate tubular body about the outer circumference of the first tubular body so as to seal the at least one fluid delivery path channel on the outer surface of the first tubular body; and removing a section of the fitted first and second tubular bodies defining the at least one fluid delivery path so as to define the fluid conduit.

8. A fluid conduit as recited in claim 1, further including the step of after forming at least one fluid delivery channel, plating the outer surface of the first elongate tubular body with a brazing alloy.

9. A fluid conduit as recited in claim 1, wherein the second tubular body has an inner circumference greater than the outer circumference of the first tubular body.

10. A fluid conduit as recited in claim 1, wherein the step of fitting the second elongate tubular body to the first elongate tubular body includes brazing the second elongate tubular body to the first elongate tubular body.

11. A fluid conduit as recited in claim 1, wherein the step of fitting the second elongate tubular body to the first elongate tubular body includes welding the second elongate tubular body to the first elongate tubular body.

12. A plurality of expandable fluid conduits prepared by a process comprising the steps of:

defining a plurality of fluid delivery channels along the outer surface of a first elongate tubular body defining a longitudinal axis and an outer curved surface having a radius of curvature wherein each fluid delivery channel has at least one curved section defined by a first portion parallel to the longitudinal axis of the first tubular body, a second portion not parallel to the longitudinal axis of the first tubular body, and a third curved portion defined between the first portion and second portions and wherein each of the fluid delivery channels is formed so as to be nested relative to one another on the first tubular body;

fitting a second elongate tubular body having an inner circumference about the outer circumference of the first tubular body so as to seal each fluid delivery path channel on the outer surface of the first tubular body; and removing a plurality of sections from the fitted first and second tubular bodies wherein each removed section corresponds to a respective fluid delivery channel so as to define a plurality of expandable fluid conduits.

13. A plurality of expandable fluid conduits as recited in claim 12 further including the steps of:

plating the outer surface of the first elongate tubular body with a brazing alloy after forming at least one fluid delivery channel; and brazing the second elongate tubular body to the first elongate tubular body after fitting the second elongate tubular body to the first elongate tubular body.

* * * * *